US011125486B2

(12) United States Patent
Stout

(10) Patent No.: US 11,125,486 B2
(45) Date of Patent: Sep. 21, 2021

(54) ADJUSTABLE ICE CRUSHER

(71) Applicant: Haier US Appliance Solutions, Inc., Wilmington, DE (US)

(72) Inventor: Mark Allen Stout, Elberfeld, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 123 days.

(21) Appl. No.: 16/424,545

(22) Filed: May 29, 2019

(65) Prior Publication Data

US 2020/0378672 A1 Dec. 3, 2020

(51) Int. Cl.
*F25C 5/04* (2006.01)

(52) U.S. Cl.
CPC ..... *F25C 5/046* (2013.01)

(58) Field of Classification Search
CPC ..... F25C 5/046; Y10S 241/17; B02C 7/14
USPC ..... 241/259.1
See application file for complete search history.

(56) References Cited

U.S. PATENT DOCUMENTS 135,556 A * 2/1873 Hudner et al. ..... B02C 1/04 241/267
706,773 A * 8/1902 Nichols ..... F25C 1/147 62/320
1,072,033 A * 9/1913 Reynolds ..... B02C 7/14 241/259.3
1,184,072 A * 5/1916 Carson ..... B02C 7/14 241/259.3
1,244,352 A * 10/1917 McNally ..... B02C 7/14 241/259.3
2,610,803 A * 9/1952 Bayston ..... F25C 5/046 241/259.1
3,684,200 A * 8/1972 Reinhall ..... B02C 7/14 241/259.1
5,273,219 A 12/1993 Beach, Jr. et al.
6,377,022 B1 4/2002 Rhoads
6,657,427 B2 * 12/2003 ÅAkerblom ..... B02C 7/14 324/207.15
6,892,973 B2 * 5/2005 Johansson ..... B02C 7/02 241/261.2
7,412,350 B2 * 8/2008 Fralic ..... B02C 7/14 702/183
7,954,738 B2 * 6/2011 Lee ..... F25C 5/046 241/37

(Continued)

FOREIGN PATENT DOCUMENTS

KR 20050076357 A 7/2005
KR 10111905 B1 2/2012

*Primary Examiner* — Christopher R Zerphey
(74) *Attorney, Agent, or Firm* — Dority & Manning, P.A.

(57) ABSTRACT

An adjustable ice crusher includes a first plate having a crushing surface and a second plate having a crushing surface. The crushing surface of the second plate is angled relative to the crushing surface of the first plate such that a crushing zone is defined between the crushing surfaces of the first and second plates. A motor is coupled to the second plate such that the second plate is rotatable with the motor. The first and second plates are configured to crush ice in the crushing zone during operation of the motor. The first plate is rotatable relative to the second plate such that an angle defined between the crushing surface of the first plate and the crushing surface of the second plate is adjustable in order to vary a size of crushed ice chips from the crushing zone.

16 Claims, 4 Drawing Sheets

(56) References Cited

U.S. PATENT DOCUMENTS 8,109,454 B2 * 2/2012 Lehtonen ..... B02C 7/08
241/30

* cited by examiner

ADJUSTABLE ICE CRUSHER

FIELD OF THE INVENTION

The present subject matter relates generally to ice crushers for appliances.

BACKGROUND OF THE INVENTION

Refrigerator appliances frequently include a dispenser for dispensing ice cubes. The ice cubes may be dispensed whole or may be crushed depending upon a user preference. An ice crusher is provided within the refrigerator appliance to crush the ice cubes.

Known ice crushers have drawbacks. For example, certain ice crushers include multiple rotating blades and multiple fixed blades. The rotating blades rotate between the fixed blades, and the ice cubes are crushed between the rotating and fixed blades. The spacing between the rotating and fixed blades is generally fixed such that a size of the crushed ice is constant. In addition, crushing the ice between the rotating and fixed blades can require a high torque motor increases production costs.

BRIEF DESCRIPTION OF THE INVENTION

Aspects and advantages of the invention will be set forth in part in the following description, or may be apparent from the description, or may be learned through practice of the invention.

In a first example embodiment, an adjustable ice crusher includes a first plate having a crushing surface and a second plate having a crushing surface. The crushing surface of the second plate is angled relative to the crushing surface of the first plate such that a crushing zone is defined between the crushing surfaces of the first and second plates. A motor is coupled to the second plate such that the second plate is rotatable with the motor. The first and second plates are configured to crush ice in the crushing zone during operation of the motor. The first plate is rotatable relative to the second plate such that an angle defined between the crushing surface of the first plate and the crushing surface of the second plate is adjustable in order to vary a size of crushed ice chips from the crushing zone.

In a second example embodiment, an adjustable ice crusher includes a first plate having a crushing surface and a second plate having a crushing surface. The crushing surface of the second plate faces the crushing surface of the first plate such that a crushing zone is defined between the crushing surfaces of the first and second plates. A motor is coupled to the second plate such that the second plate is rotatable with the motor. The first and second plates are configured to crush ice in the crushing zone during operation of the motor. The first plate is one or both of rotatable and translatable relative to the second plate such that a spacing between the crushing surface of the first plate and the crushing surface of the second plate is adjustable in order to vary a size of crushed ice chips from the crushing zone.

In a third example embodiment, an appliance includes a cabinet that defines a chilled chamber and an adjustable ice crusher disposed within the cabinet. The adjustable ice crusher includes a first plate having a crushing surface and a second plate having a crushing surface. The crushing surface of the second plate is angled relative to the crushing surface of the first plate such that a crushing zone is defined between the crushing surfaces of the first and second plates. A motor is coupled to the second plate such that the second plate is rotatable with the motor. The first and second plates are configured to crush ice in the crushing zone during operation of the motor. The first plate is rotatable relative to the second plate such that an angle defined between the crushing surface of the first plate and the crushing surface of the second plate is adjustable in order to vary a size of crushed ice chips from the crushing zone.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
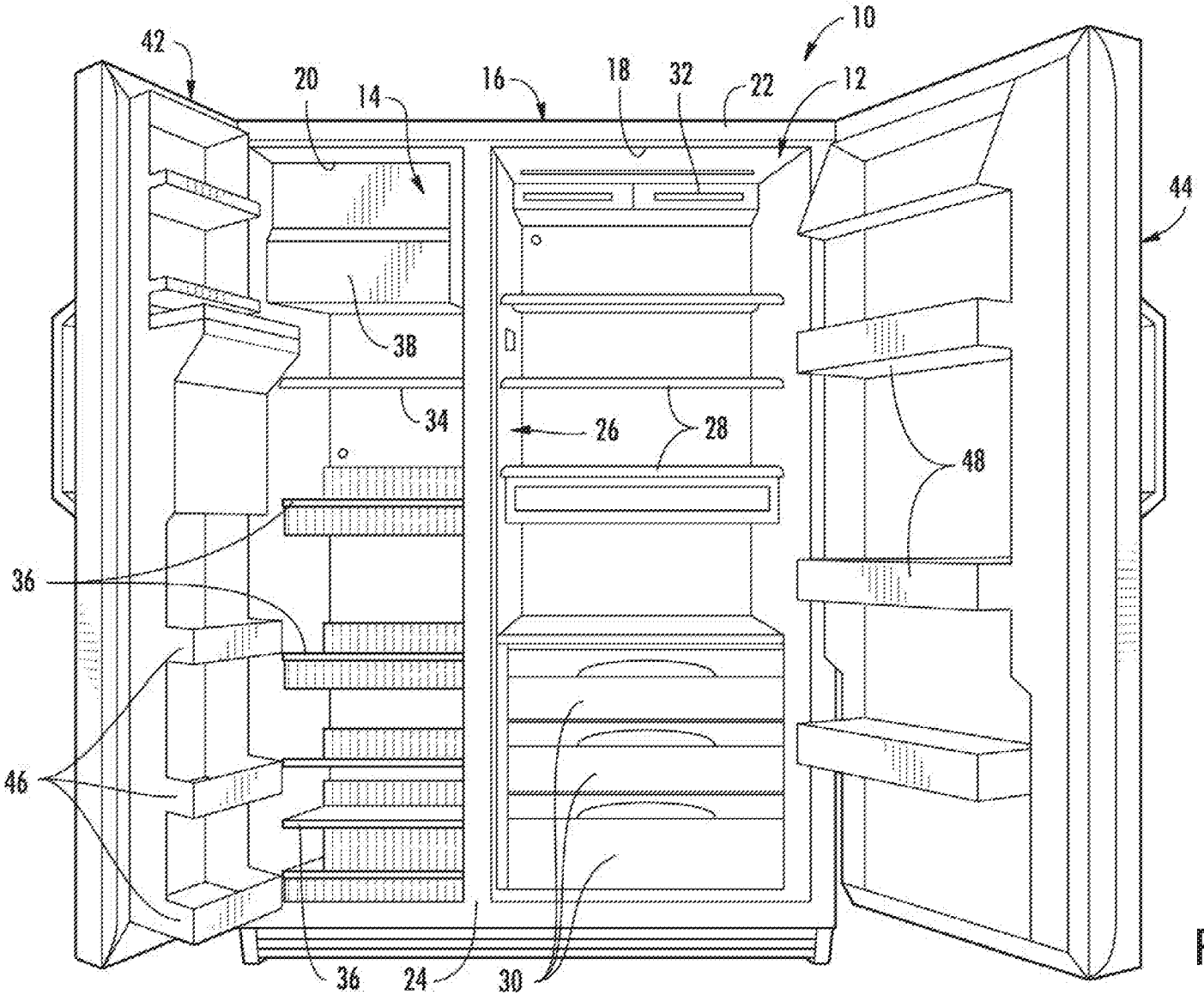
FIG. 1 is a front, elevation view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a front, elevation view of a refrigerator appliance 10 according to an example embodiment of the present subject matter. More specifically, for illustrative purposes, the present subject matter is described with refrigerator appliance 10 having a construction as shown and described further below. As used herein, "refrigerator appliance" includes appliances such as a refrigerator/freezer combination, side-by-side, bottom mount, compact, and any other style or model of refrigerator appliance. Accordingly, other configurations including multiple and different styled compartments could be used with refrigerator appliance 10, it being understood that refrigerator appliance 10 shown in FIG. 1 is provided by way of example only.

Refrigerator appliance 10 includes a fresh food storage compartment 12 and a freezer storage compartment 14. Freezer compartment 14 and fresh food compartment 12 are arranged side-by-side within a cabinet or housing that includes an outer case 16 and inner liners 18, 20. Freezer compartment 14 and fresh food compartment 12 are defined by inner liners 18 and 20 within outer case 16. A space between case 16 and liners 18 and 20, and between liners 18 and 20, is filled with foamed-in-place insulation. Outer case 16 normally is formed by folding a sheet of a suitable material, such as pre-painted steel, into an inverted U-shape to form the top and side walls of case 16. A bottom wall of case 16 normally is formed separately and attached to the case side walls and to a bottom frame that provides support for refrigerator appliance 10. Inner liners 18 and 20 are molded from a suitable plastic material to form freezer compartment 14 and fresh food compartment 12, respectively. Alternatively, liners 18, 20 may be formed by bending and welding a sheet of a suitable metal, such as steel.

A breaker strip 22 extends between a case front flange and outer front edges of liners 18, 20. Breaker strip 22 is formed from a suitable resilient material, such as an extruded acrylo-butadiene-styrene based material (commonly referred to as ABS). The insulation in the space between liners 18, 20 is covered by another strip of suitable resilient material, which also commonly is referred to as a mullion 24. In one embodiment, mullion 24 is formed of an extruded ABS material. Breaker strip 22 and mullion 24 form a front face, and extend completely around inner peripheral edges of case 16 and vertically between liners 18, 20. Mullion 24, insulation between compartments, and a spaced wall of liners separating compartments, sometimes are collectively referred to herein as a center mullion wall 26.

An ice maker 38 may be provided in freezer compartment 14. A freezer door 42 and a fresh food door 44 close access openings to freezer and fresh food compartments 14, 12, respectively. Each door 42, 44 is mounted to rotate about its outer vertical edge between an open position, as shown in FIG. 1, and a closed position (not shown) closing the associated storage compartment.

Shelves 28 and slide-out storage drawers 30, sometimes referred to as storage pans, are provided in fresh food compartment 12 to support items being stored therein. A shelf 34 and wire baskets 36 are also provided in freezer compartment 14. Freezer door 42 includes a plurality of storage shelves 46, and fresh food door 44 includes a plurality of storage shelves 48. Thus, refrigerator appliance 10 includes various storage assemblies on cabinet 12, freezer door 42 and/or fresh food door 44 for supporting food items within fresh food compartment 12 and freezer compartment 14.

Figure 2:
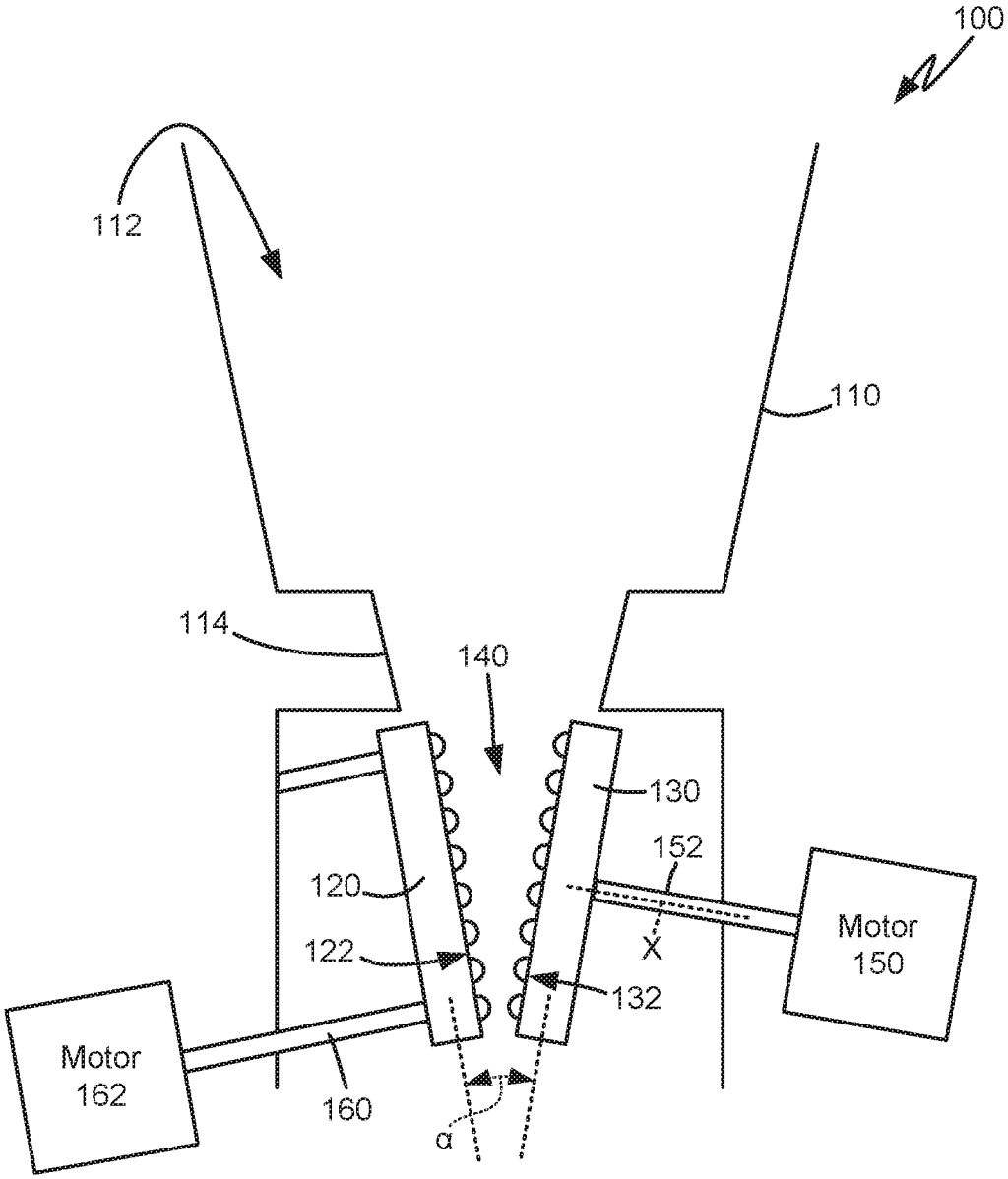
FIG. 2 is a schematic view of an ice crusher according to an example embodiment of the present subject matter.

FIG. 2 is a schematic view of an ice crusher 100 according to an example embodiment of the present subject matter. Ice crusher 100 may be used in an appliance to crush ice cubes. For example, ice crusher 100 may be positioned within refrigerator appliance 10 to selectively crush ice cubes from ice maker 38. Thus, ice crusher 100 is described in greater detail below in the context of refrigerator appliance 10. It will be understood that ice crusher 100 may be used in any other suitable appliance, such as a standalone ice maker appliance, a countertop ice maker, etc., in alternative example embodiments. As discussed in greater detail below, ice crusher 100 includes features for adjusting the size of crushed ice chips.

As shown in FIG. 2, ice crusher 100 may include an ice cube hopper 110. Ice cube hopper 110 may be positioned for receipt of ice cubes from ice maker 38. Thus, e.g., ice cube hopper 110 may be positioned below ice maker 38 within freezer compartment 14, and ice cubes from ice maker 38 may fall into an interior volume 112 of ice cube hopper 110. In alternative example embodiments, ice cube hopper 110 may be manually filled with ice cubes, e.g., when ice crusher 100 is used as a standalone ice crusher. Interior volume 112 may be sized to store a suitable volume of ice cubes, e.g., no less than a half-gallon of ice cubes, such that a reserve of ice cubes is available within ice cube hopper 110 for dispensing.

Ice crusher 100 also includes a first plate 120 having a crushing surface 122 and a second plate 130 having a crushing surface 132. Crushing surface 132 of second plate 130 is spaced from crushing surface 122 of first plate 120 such that a crushing zone 140 is defined between crushing surfaces 122, 132 of first and second plates 120, 130. During operation of ice crusher 100, ice cubes within crushing zone 140 are crushed, chipped, ground, etc., as described in greater detail below.

Ice cube hopper 110 may be positioned above crushing zone 140. Thus, e.g., ice cubes within interior volume 112 of ice cube hopper 110 may flow into crushing zone 140. In particular, an outlet 114 of interior volume 112 may be positioned directly over crushing zone 140 such that ice cubes within interior volume 112 are funneled into crushing zone 140 via outlet 114 during operation of ice crusher 100.

A motor 150 is coupled to second plate 130. Thus, second plate 130 is rotatable with motor 150. For example, a shaft 152 of motor 150 may be coupled to second plate 130. First and second plates 120, 130 are configured to crush ice cubes in crushing zone 140 during operation of motor 150. For example, when motor 150 rotates second plate 130, crushing surfaces 122, 132 of first and second plates 120, 130 may impact against ice cubes within crushing zone 140, and crushing surfaces 122, 132 of first and second plates 120, 130 may crush, chip, grind, etc. ice cubes within crushing zone 140. In certain example, embodiments, motor 150 is operable to rotate second plate 130 about an axis X. Crushing surface 132 of second plate 130 may be oriented perpendicular to the axis X. Thus, e.g., crushing surface 132 of second plate 130 may extend radially from the axis X. First plate 120 is fixed in the example embodiment shown in FIG. 2. In alternative example, embodiments, first plate 120 may be rotatable, e.g., with motor 150 or another motor, in the manner described above for second plate 130.

Crushing surface 132 of second plate 130 may be angled relative to crushing surface 122 of first plate 120. Thus, e.g., crushing zone 140 between first and second plates 120, 130 may taper such that crushing zone 140 is narrower at a bottom of crushing zone 140 and wider at a top of crushing zone 140. First plate 120 may also be rotatable relative to the second plate such that an angle $\alpha$ defined between crushing surface 122 of first plate 120 and crushing surface 132 of second plate 130 is adjustable in order to vary a size of crushed ice chips from crushing zone 140. Thus, the tapering of crushing zone 140 may be adjustable. As an example, first plate 120 may be rotatable relative to second plate 130 by no less than ten degrees (10°). Such rotatablity may allow suitable adjustment in the sizing of crushed ice chips from crushing zone 140. The angle $\alpha$ may be defined in a plane that is perpendicular to horizontal in certain example embodiments.

By changing the angle $\alpha$, a width of crushing zone 140, e.g., at the bottom of crushing zone 140, may be changed. Ice cubes within crushing zone 140 are crushed, chipped, ground, etc. between crushing surfaces 122, 132 of first and second plates 120, 130 during operation of motor 150. In particular, the ice cubes are held within crushing zone 140 until crushed to a size equal to or less than the width of crushing zone 140, e.g., at the bottom of crushing zone 140. By changing the angle $\alpha$, the size of crushed ice that exits crushing zone 140 also changes. The adjustability of the size of crushed ice is advantageous over known ice crushers that only provide a fixed size of crushed ice. The angle α may also be minimized or otherwise adjusted to dispense whole ice cubes through crushing zone 140. Thus, e.g., first plate 120 may be rotated to allow dispensing of whole ice cubes through crushing zone 140.

To rotate first plate 120 relative to second plate 130, ice crusher 100 may include an adjustment screw 160 coupled to first plate 120. Adjustment screw 160 may be connected such that rotating adjustment screw 160 causes first plate 120 to rotate relative to second plate 130 thereby adjusting the angle α between crushing surfaces 122, 132 of first and second plates 120, 130. A motor 162 may be coupled to adjustment screw 160. Motor 162 may be operable to rotate adjustment screw 160 and thus change the angle α. In alternative example embodiments, first plate 120 may be manually rotatable relative to second plate 130, or ice crusher 100 may include a linear actuator, stepper motor, etc. for rotating first plate 120 relative to second plate 130.

Figure 3:
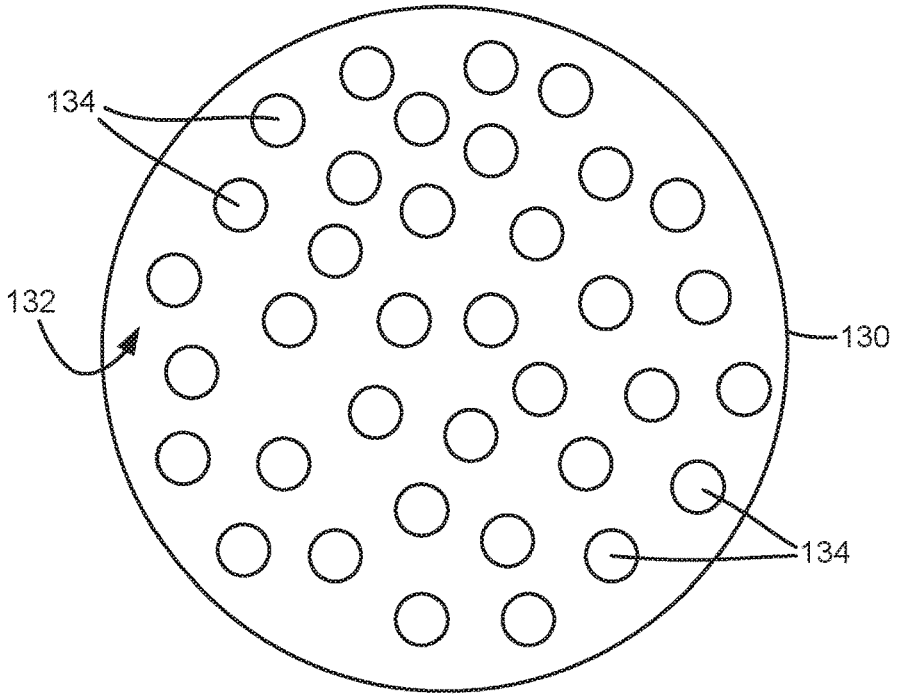
FIG. 3 is an elevation view of a crushing plate of the ice crusher of FIG. 2.

FIG. 3 is an elevation view of second plate 130. First plate 120 may be constructed in the same or similar manner to that shown in FIG. 3 for second plate 120. Only second plate 130 is described in greater detail below with reference to FIG. 3 for the sake of brevity but such description is equally applicable to first plate 120. As shown in FIG. 3, second plate 130 may be circular. In addition, crushing surface 132 of second plate 130 may include a plurality of burrs 134. Burrs 134 may extend outwardly from second plate 130, e.g., along the axis X. Burrs 134 assist with crushing ice within crushing zone 140. For example, burrs 134 may push ice cubes towards the bottom of crushing zone 140 and/or against crushing surface 122 of first plate 120.

Figure 4:
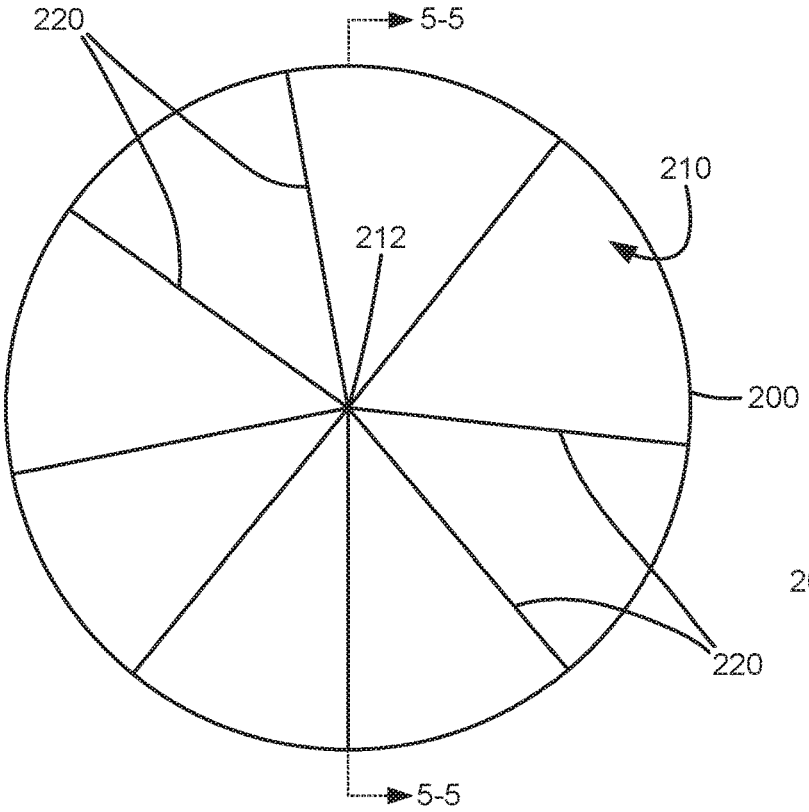
FIG. 4 is an elevation view of a crushing plate according to an example embodiment of the present subject matter that may be used with the ice crusher of FIG. 2.
Figure 5:
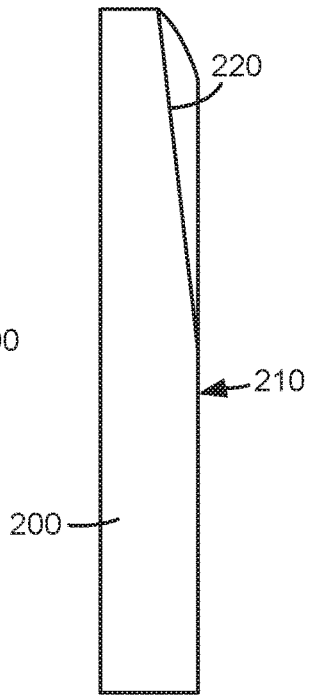
FIG. 5 is a side view of the crushing plate of FIG. 4.

FIG. 4 is an elevation view of a crushing plate 200 according to an example embodiment of the present subject matter that may be used with ice crusher 100. FIG. 5 is a side view of crushing plate 200. First plate 120 and/or second plate 130 may be constructed in the same or similar manner to that shown in FIGS. 4 and 5 for crushing plate 200. As shown in FIGS. 4 and 5, a crushing surface 210 of crushing plate 200 may include a plurality of teeth 220. Teeth 220 extend radially from a center 212 of crushing surface 210, e.g., perpendicular to the axis X. Teeth 220 assist with crushing ice within crushing zone 140. For example, teeth 220 may push ice cubes towards the bottom of crushing zone 140 and/or against an opposing plate.

Figure 6:
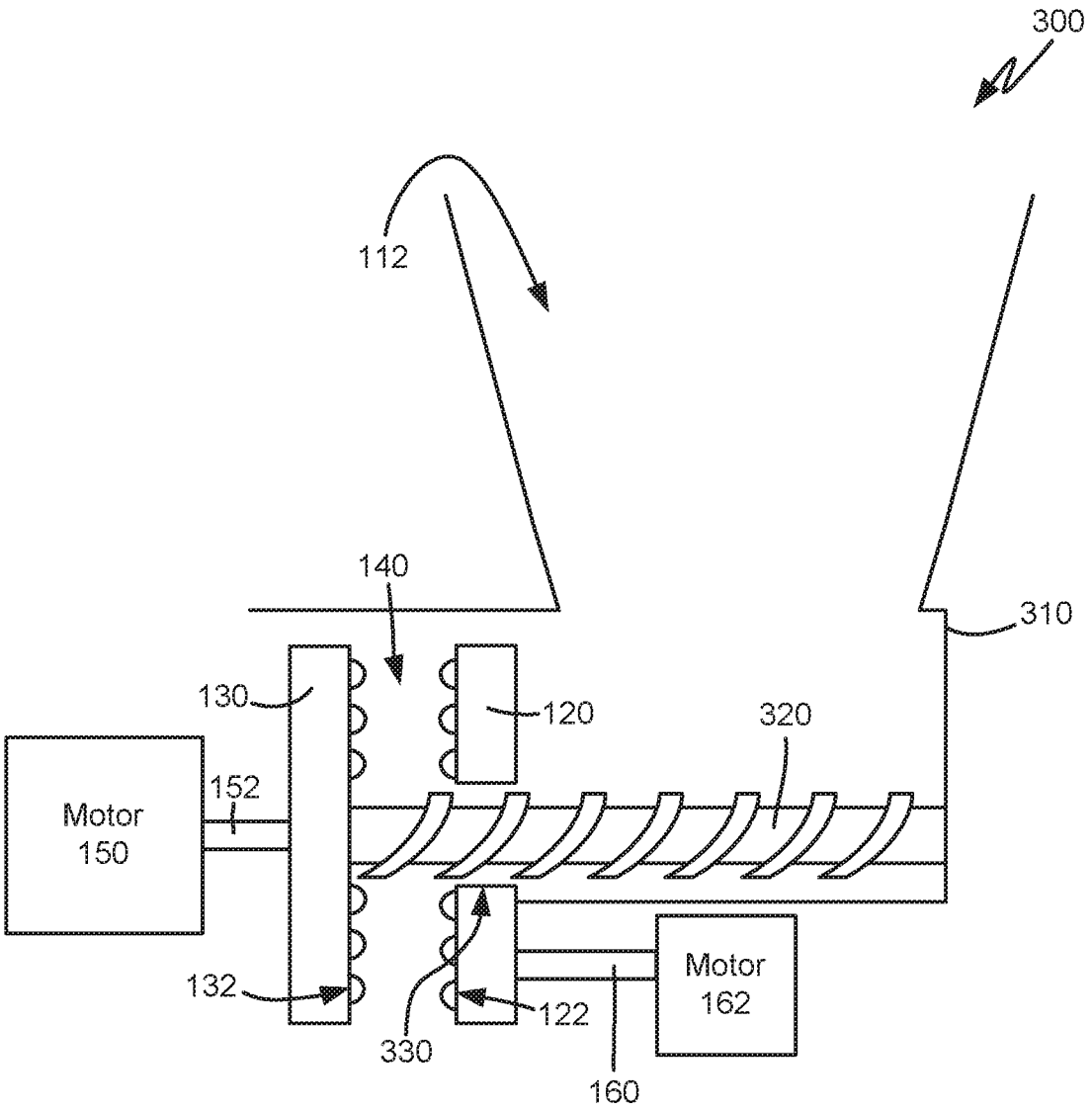
FIG. 6 is a schematic view of an ice crusher according to another example embodiment of the present subject matter.

FIG. 6 is a schematic view of an ice crusher 300 according to another example embodiment of the present subject matter. Ice crusher 300 includes numerous common or similar components as ice crusher 100. Additional features of ice crusher 300 are described in greater detail below.

As shown in FIG. 6, ice crusher 300 includes an ice cube hopper 310 and an auger 320. Auger 320 may be positioned within ice cube hopper 310. In addition, auger 320 may be coupled to motor 150. Thus, motor 150 may be operable to rotate auger 320. Threads on auger 320 draw or push ice cubes within ice cube hopper 310 into crushing zone 140 when auger 320 rotates. Auger 320 may also be coupled to second plate 130. Thus, motor 150 may be operable to simultaneously rotate second plate 130 and auger 320. Auger 320 may extend from second plate 130 through a hole 330 in first plate 120 into ice cube hopper 310. Hole 330 may be positioned at a center of first plate 120.

A gap between crushing surface 132 of second plate 130 and crushing surface 122 of first plate 120 may be adjustable in order to vary a size of crushed ice chips from crushing zone 140. Thus, the width of crushing zone 140 may be adjustable. Ice cubes within crushing zone 140 are crushed, chipped, ground, etc. between crushing surfaces 122, 132 of first and second plates 120, 130. In particular, auger 320 drives the ice cubes into crushing zone 140, and the ice cubes are crushed to a size equal to or less than the width of crushing zone 140. By changing the width of the crushing zone 140, the size of crushed ice that exits crushing zone 140 also changes. The adjustability of the size of crushed ice is advantageous over known ice crushers that only provide a fixed size of crushed ice.

Adjustment screw 160 is coupled to first plate 120 to translate first plate 120 relative to second plate 130. Adjustment screw 160 may be connected such that rotating adjustment screw 160 causes first plate 120 to translate relative to second plate 130 thereby adjusting the width of the crushing zone 140. Motor 162 may be operable to rotate adjustment screw 160 and thus change the width of the crushing zone 140. In various example embodiments, first plate 120 is one or both of rotatable and translatable relative to second plate 130 such that a spacing between crushing surface 122 of first plate 120 and crushing surface 132 of second plate 130 is adjustable in order to vary a size of crushed ice chips from crushing zone 140. Thus, e.g., it will be understood that in ice crusher 100 (FIG. 2) first plate 120 may also be translatable relative to second plate 130 such that the spacing between crushing surface 122 of first plate 120 and crushing surface 132 of second plate 130 is adjustable, e.g., in addition to or in lieu of the relative rotation between first and second plates 120, 130.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An adjustable ice crusher, comprising:

a first plate having a crushing surface;

a second plate having a crushing surface, the crushing surface of the second plate is angled relative to the crushing surface of the first plate such that a crushing zone is defined between the crushing surfaces of the first and second plates; and a motor coupled to the second plate such that the second plate is rotatable with the motor, the first and second plates configured to crush ice in the crushing zone during operation of the motor, wherein the first plate is rotatable relative to the second plate such that an angle defined between the crushing surface of the first plate and the crushing surface of the second plate is adjustable in order to vary a size of crushed ice chips from the crushing zone, wherein the first and second plates are circular, wherein the crushing surface of the second plate is spaced from the crushing surface of first plate, and the crushing zone tapers such that the crushing zone is narrower at a bottom of the crushing zone and wider at a top of the crushing zone, and wherein the first plate is rotatable about an axis that is perpendicular to the crushing surface of the first plate.

2. The adjustable ice crusher of claim 1, wherein the motor is operable to rotate the second plate about an axis, and the crushing surface of the second plate is oriented perpendicular to the axis.

3. The adjustable ice crusher of claim 1, wherein the crushing surface of the second plate comprises a plurality of teeth extending radially from a center of the crushing surface of the second plate.

4. The adjustable ice crusher of claim 1, wherein the crushing surface of the second plate comprises a plurality of burrs that extend outwardly from the second plate.

5. The adjustable ice crusher of claim 1, further comprising an adjustment screw coupled to the first plate, the adjustment screw configured to rotate the first plate relative to the second plate to adjust the angle defined between the crushing surface of the first plate and the crushing surface of the second plate.

6. The adjustable ice crusher of claim 1, further comprising an ice cube hopper positioned above the crushing zone.

7. The adjustable ice crusher of claim 1, wherein a plurality of burrs extend outwardly from the crushing surface of the second plate.

8. An adjustable ice crusher, comprising:

a first plate having a crushing surface;

a second plate having a crushing surface, the crushing surface of the second plate faces the crushing surface of the first plate such that a crushing zone is defined between the crushing surfaces of the first and second plates; and a motor coupled to the second plate such that the second plate is rotatable with the motor, the first and second plates configured to crush ice in the crushing zone during operation of the motor, wherein the first plate is one or both of rotatable and translatable relative to the second plate such that a spacing between the crushing surface of the first plate and the crushing surface of the second plate is adjustable in order to vary a size of crushed ice chips from the crushing zone, wherein the first and second plates are circular, wherein the crushing surface of the second plate is spaced from the crushing surface of first plate, and the crushing zone tapers such that the crushing zone is narrower at a bottom of the crushing zone and wider at a top of the crushing zone, and wherein the first plate is rotatable about an axis that is perpendicular to the crushing surface of the first plate.

9. An appliance, comprising:

a cabinet defining a chilled chamber; and an adjustable ice crusher disposed within the cabinet, the adjustable ice crusher comprising a first plate having a crushing surface;

a second plate having a crushing surface, the crushing surface of the second plate is angled relative to the crushing surface of the first plate such that a crushing zone is defined between the crushing surfaces of the first and second plates; and a motor coupled to the second plate such that the second plate is rotatable with the motor, the first and second plates configured to crush ice in the crushing zone during operation of the motor, wherein the first plate is rotatable relative to the second plate such that an angle defined between the crushing surface of the first plate and the crushing surface of the second plate is adjustable in order to vary a size of crushed ice chips from the crushing zone, wherein the first and second plates are circular, wherein the crushing surface of the second plate is spaced from the crushing surface of first plate, and the crushing zone tapers such that the crushing zone is narrower at a bottom of the crushing zone and wider at a top of the crushing zone, and wherein the first plate is rotatable about an axis that is perpendicular to the crushing surface of the first plate.

10. The appliance of claim 9, wherein the motor is operable to rotate the second plate about an axis, and the crushing surface of the second plate is oriented perpendicular to the axis.

11. The appliance of claim 9, wherein the crushing surface of the second plate comprises a plurality of teeth extending radially from a center of the crushing surface of the second plate.

12. The appliance of claim 9, wherein the crushing surface of the second plate comprises a plurality of burrs that extend outwardly from the second plate.

13. The appliance of claim 9, further comprising an adjustment screw coupled to the first plate, the adjustment screw configured to rotate the first plate relative to the second plate to adjust the angle defined between the crushing surface of the first plate and the crushing surface of the second plate.

14. The appliance of claim 9, further comprising an ice cube hopper positioned above the crushing zone.

15. The appliance of claim 9, wherein the first plate is rotatable relative to the second plate by no less than ten degrees.

16. The appliance of claim 9, wherein a plurality of burrs extend outwardly from the crushing surface of the second plate.

* * * * *